US007118409B2

(12) United States Patent
Kuroda et al.

(10) Patent No.: US 7,118,409 B2
(45) Date of Patent: Oct. 10, 2006

(54) CONNECTOR AND CABLE RETAINER

(75) Inventors: Keiji Kuroda, Aichi (JP); Ryo Moriwake, Osaka (JP); Kiyoshi Aramoto, Osaka (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/201,374

(22) Filed: Aug. 10, 2005

(65) Prior Publication Data

US 2006/0035523 A1 Feb. 16, 2006

(30) Foreign Application Priority Data

Aug. 11, 2004 (JP) ..... 2004-234605

(51) Int. Cl.
*H01R 12/24* (2006.01)

(52) U.S. Cl. ..... 439/497

(58) Field of Classification Search ..... 439/497, 439/579

See application file for complete search history.

(56) References Cited

FOREIGN PATENT DOCUMENTS

JP 10-74548 * 3/1998

* cited by examiner

*Primary Examiner*—Javaid H. Nasri
(74) *Attorney, Agent, or Firm*—Osha Liang LLP

(57) ABSTRACT

A connector is provided with a cable retainer which has a thin plate extending in one direction, five main parts projecting from the thin plate so as to align along the extending direction, and caulking portions projecting from the main parts so as to cross at right angles in the extending direction of the main parts. The cable retainer clips cables between the caulking portions plastically deformed by caulking and the main parts.

4 Claims, 8 Drawing Sheets

CONNECTOR AND CABLE RETAINER

BACKGROUND OF THE INVENTION

1. Field of the Invention

The present invention relates to a connector and a cable retainer to which a plurality of cables are connected.

2. Description of Related Art

In conjunction with downsizing of electronics devices, pitches of electrodes in a connector used in these have progressively become narrower. Cables are connected to a connector by solder-joining electric wires in the cable to electrodes in the connector. In the connector with narrowed pitches, the surface area of each electrode becomes smaller than that of a connector with normal pitches, and the diameter of each electrical wire in the cable is reduced so as to match the width of the electrode, so that the joint area between the electrode and the electrical wire becomes smaller. Therefore, the strength of the solder joining between the electrode and the electrical wire lowers, resulting in easy disconnection of the solder joining between the electrode and a substrate due to a stress or the like from the cable. Therefore, for these connectors, a technique in that a U-shaped terminal is provided to clip a portion near the end of the solder-joined cable is generally known (Japanese Published Unexamined Patent Application No. H11-260439). According to this technique, the U-shaped terminal clips the portion near the end of the cable between its opposite inner walls, so that the stress from the cable is reduced at the clipping portion. Thereby, the solder joining between the electrical wire and the electrode becomes difficult to come off.

However, with the above-described technique, the cable is clipped between terminal inner walls, so that the cable retaining force of the terminal lowers as the cable diameter becomes small. Namely, a cable diameter that the terminal can clip is limited. Additionally, by only clipping the cable, it is difficult to securely retain the cable so as to resist a tensile stress of the cable.

SUMMARY OF THE INVENTION

Therefore, a main object of the invention is to provide a connector and a cable retainer which allows a wide range of connectable cable diameters and can securely retain cables.

A connector of the invention includes a conductive cable retainer that retains a plurality of cables, a supporter that supports the cable retainer, and a plurality of terminals that are supported by the supporter and joined to cable cores retained by the cable retainer, wherein the cable retainer has a thin plate that extends in one direction, a plurality of plate-shaped main parts projecting from the thin plate so as to align along the extending direction, and projections that project from the main parts and clip the cables disposed on the main parts between the projections and the main parts by being plastically deformed by caulking.

The cable retainer of the invention includes a conductive thin plate extending in one direction, a plurality of plate-shaped main parts projecting from the thin plate so as to align along the extending direction, and projections that project from the main parts and clip the cables disposed on the main parts between the projections and the main parts by being plastically deformed by caulking.

According to the invention, cables are retained by plastically deforming the projections by caulking, so that various cables with different diameters can be securely retained.

According to the invention, it is preferable that the supporter is in contact with the cable retainer and includes a conductive shell that encloses the joined portions between the cable cores and the terminals. Thereby, the cable cores exposed from the cables can be shielded.

According to the invention, when the cable has a core, an insulator that encloses the core, and a shield material as a mesh-like metal member enclosing the insulator, it is preferable that the projections clip the cables at the shield materials between the projections and the main parts. Thereby, the shield materials of the plurality of cables can be collectively grounded, and the shield effect can be increased.

BRIEF DESCRIPTION OF THE DRAWINGS

Other and further objects, features and advantages of the invention will appear more fully from the following description taken in connection with the accompanying drawings in which:

FIG. 1 is a perspective view of a connector of an embodiment of the invention and the opposing connector that said connector is inserted into and extracted from;

DESCRIPTION OF THE PREFERRED EMBODIMENTS

Hereinafter, a connector of a preferred embodiment of the invention is described with reference to the drawings.

Figure 1:
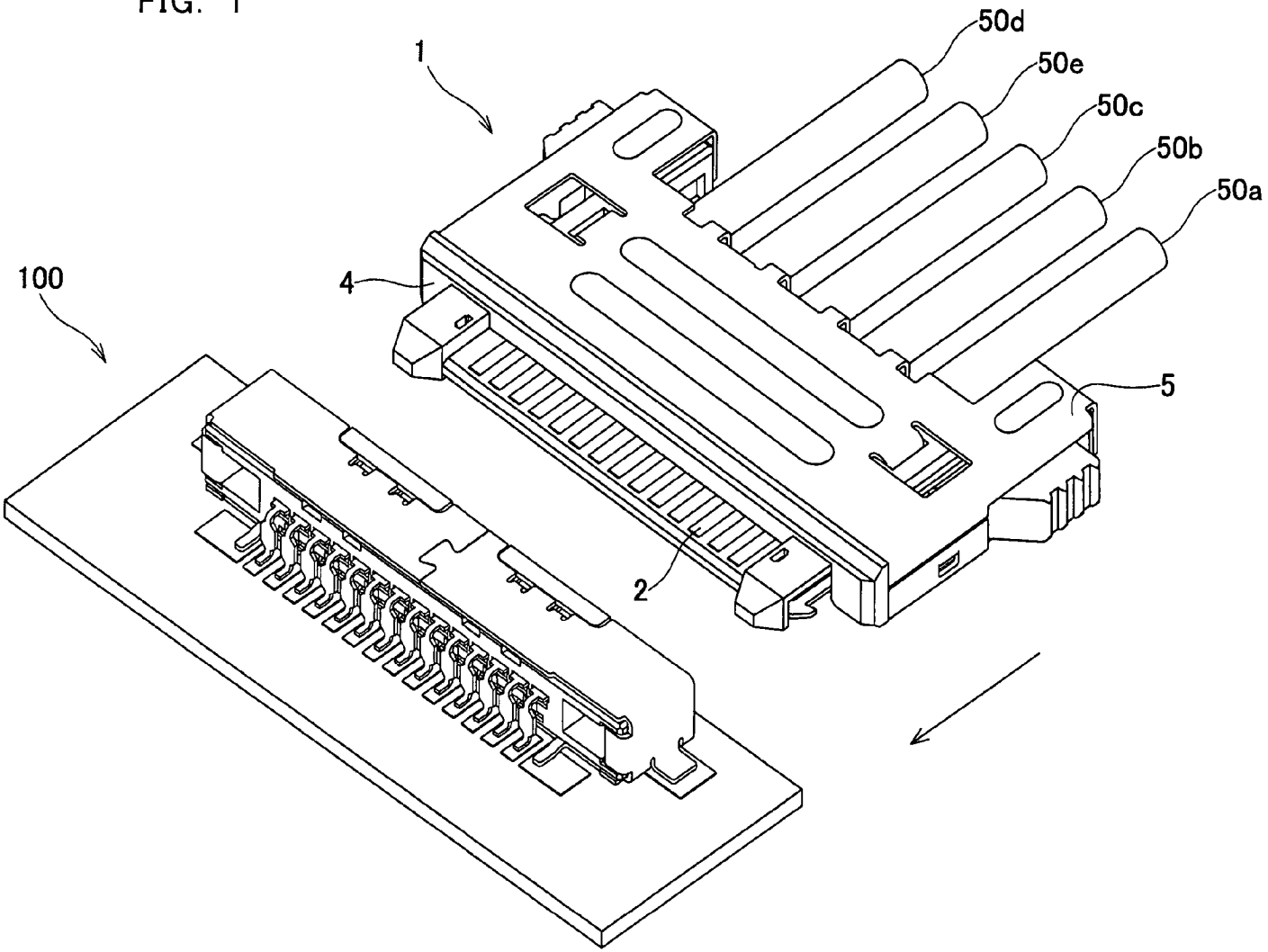
Figure 2:
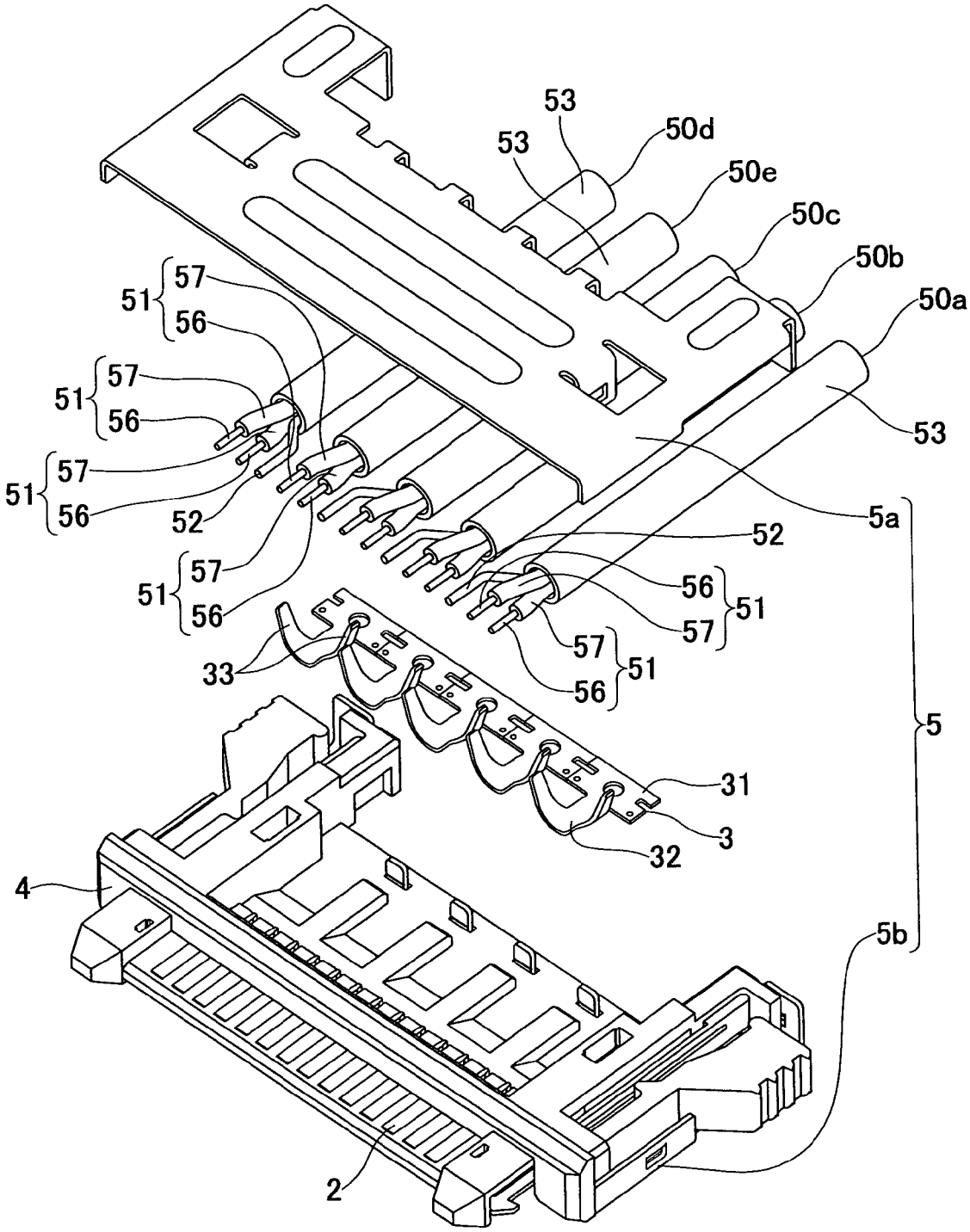
FIG. 2 is an exploded perspective view of the connector of FIG. 1.

FIG. 1 is a perspective view of the connector of the preferred embodiment of the invention and the opposing connector that said connector is inserted into and extracted from. The arrow shown in the figure indicates the inserting direction of the connector 1 into the opposing connector 100. FIG. 2 is an exploded perspective view of the connector 1. As shown in FIG. 1, to the connector 1, five cables 50*a* through 50*e* are connected, and the connector 1 can be inserted into and extracted from the opposing connector 100. The connector 1 includes fourteen terminals 2 that are aligned at a predetermined pitch in a direction orthogonal to the inserting direction of the connector 1, a cable retainer 3, a housing (supporter) 4, and a shell 5.

As shown in FIG. 2, the terminals 2 are thin-plate electrodes extending along the inserting direction of the connector 1, which are electrically connected to opposing electrodes of the opposing connector 100 at the front ends thereof and electrically connected to cables 50*a* through 50*e* by solder-joining at the rear ends thereof. The cable retainer 3 is a metal-made member that retains the cables 50*a* through 50*e* at a predetermined pitch. The housing 4 supports the terminals 2 and the cable retainer 3. The shell 5 is a metal-made member that is disposed so as to cover the terminals 2 and the ends of the cables 50*a* through 50*e* electrically connected to the terminals, and includes an upper shell 5*a* disposed on the upper half of the connector 1 and a lower shell 5*b* disposed at the lower half of the connector 1.

The cables 50*a* through 50*d* have two signal wires 51, a groundwire 52, and a jacket 53 covering the outer circumferences of the two signal wires 51 and the ground wire 52. The cable 50*e* has two signal wires 51 and a jacket 53 covering the outer circumferences of the two signal wires 51. The signal wire 51 has a core 56 and a jacket 57 covering the outer circumference of the core 56. The ends of the signal wires 51 and the ground wires 52 of the cables 50*a* through 50*e* to be connected to the connector 1 are exposed from the jackets 53 at the connecting ends to the terminals 2. At the further ends of the exposed signal wires 51, the ends of the cores 56 are exposed from the jackets 57.

Figure 3A:
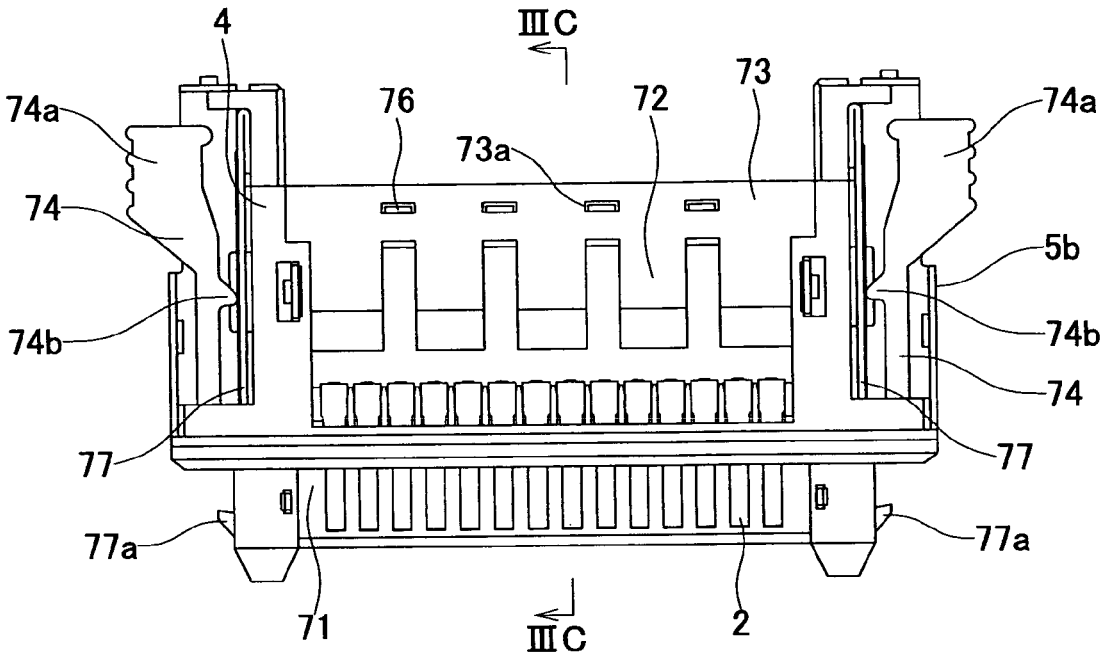
FIG. 3A is a view of the housing of FIG. 2 from above.
Figure 3B:
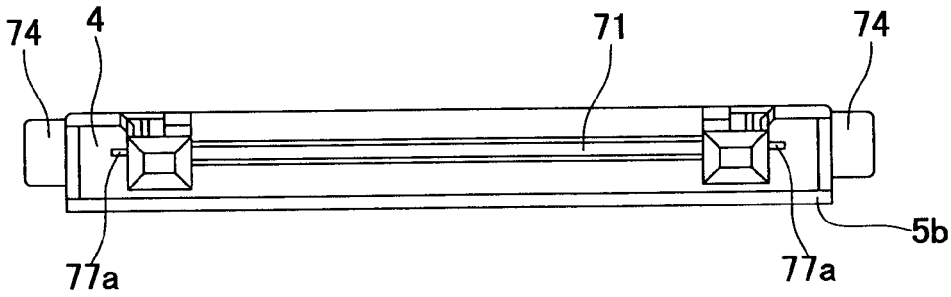
FIG. 3B is a front view of the housing of FIG. 2.
Figure 3C:
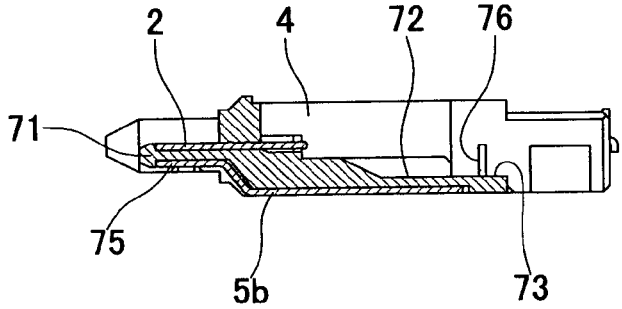
FIG. 3C is a sectional view of the housing along the IIIC—IIIC line of FIG. 3A.

Next, the housing 4 is described in detail with reference to FIG. 3A, FIG. 3B, and FIG. 3C. FIG. 3A is a view of the housing 4 from above. FIG. 3B is a front view of the housing 4. FIG. 3C is a sectional view of the housing 4 along the IIIC—IIIC line of FIG. 3A. The housing 4 shown in the figures is attached with the lower shell 5*b*. The housing 4 is formed from a resin as an insulator, and includes a terminal supporting portion 71, five concave portions 72, a concave portion 73, and two displacing pieces 74.

As shown in FIG. 3A and FIG. 3B, the terminal supporting portion 71 extends along the aligning direction of the terminals 2 at the front end of the housing 4, and supports the terminals 2 on the surface so that the extending direction of the terminals 2 is along the inserting direction of the connector 1 and the terminals 2 align in parallel to each other along the longitudinal direction.

In the five concave portions 72, the ends of the cables 50*a* through 50*e* and a part of the cable retainer 3 are disposed, and the concave portions are formed so as to be adjacent to the rear end of the terminal supporting portion 71 and extend along the inserting direction of the connector 1. The concave portions 72 have roughly rectangular shapes extending in one direction when they are viewed from above, and the widths of the short sides thereof are slightly wider than the widths of the cables 50*a* through 50*e*. When the cables 50*a* through 50*e* are connected to the connector 1, a part of the cable retainer 3 and the ends of the cables 50*a* through 50*e* are disposed within the concave portions 72.

The concave portion 73 supports the cable retainer 3 integrally with the concave portions 72, and communicates with the five concave portions 72 while extending in the aligning direction of the terminals 2 at the connect rear ends of the concave portions 72. The bottom of the concave portion 73 is rectangular, and has four holes 73*a* that have rectangular openings so as to align along the extending directions of the concave portions. As shown in FIG. 3C, when the lower shell 5*b* is attached to the housing 4, a bent portion 76 of the lower shell 5*b*, described later, penetrates the hole 73*a*, and projects perpendicularly to the bottom of the concave portion 73.

The two displacing pieces 74 are to be pinched by a user when he/she inserts or extracts the connector 1 into or from the opposing connector 100, and as shown in FIG. 3A, the displacing pieces extend along the shorter side of the housing 4 at both longitudinal ends of the housing 4. The displacing pieces 74 have front ends fixed integrally with the side of the housing 4, and free rear ends. At the rear ends of the displacing pieces 74, swelling portions 74*a* that swell to the outside of the housing 4 are formed, and at the middle portions of the displacing pieces, projections 74*b* projecting inwardly are formed. On the outer surfaces of the swelling portions 74*a*, grooves are formed. As described later, a user pinches the two swelling portions 74*a*, whereby the displacing pieces 74 elastically deform. Thereby, the projections 74*b* displaces inwardly.

Referring to FIG. 2 again, the shell 5 is a metal-made member covering the housing 4 and has a rectangular shell shape. The shell 5 is formed so that the upper shell 5*a* and the lower shell 5*b* are separable from each other. The upper shell 5*a* is formed by integral molding of one metal thin plate, and its section orthogonal to the inserting direction of the connector 1 is C-shaped.

The lower shell 5*b* is formed by integral molding of one metal thin plate, and its section orthogonal to the inserting direction of the connector 1 is C-shaped. Then, both ends of the upper shell 5*a* and both ends of the lower shell 5*b* are connected so as to face each other, whereby the shell 5 with a rectangular shell shape is formed. In addition, as shown in FIG. 3A and FIG. 3C, the lower shell 5*b* has an electrode part 75, four bent portions 76, and two latch pieces 77.

The electrode part 75 is electrically connected to the ground electrode of the opposing connector 100 when the connector 1 is inserted into the opposing connector 100, and extends in the inserting direction as shown in FIG. 3C. Then, when the lower shell 5*b* is attached to the housing 4, the electrode part 75 is in close contact with the surface opposite the surface for supporting the terminals 2 of the terminal supporting portion 71 of the housing 4.

The bent portions 76 engage with the cable retainer 3, and as shown in FIG. 3A, FIG. 3B, and FIG. 3C, in a state before the bent portions engage with the cable retainer 3, they upwardly project from the rear end of the lower shell 5*b*. The four bent portions 76 are aligned along the aligning direction of the terminals 2. When the lower shell 5*b* is attached to the housing 4, the four bent portions 76 penetrate the four holes 73*a* formed in the bottom of the concave portion 73 of the housing 4.

The two latch pieces 77 engage with the opposing connector 100 when the connector 1 is inserted into the opposing connector 100, and extend along the inserting direction of the connector 1 at both ends of the lower shell 5*b*. Additionally, at the front ends of the latch pieces 77, engaging portions 77*a* that project toward the outside of the connector 1 and have rough triangle shapes are formed. When the lower shell 5*b* is attached to the housing 4, the two latch pieces 77 come into contact with the ends of the projections 74*b* in parallel to the displacing pieces 74. When the projections 74*b* displace inwardly due to elastic deformation of the displacing pieces 74, the projections 74*b* press the latch pieces 77. When the latch pieces 77 are pressed by the projections 74*b*, the latch pieces 77 displace inwardly. According to inward displacement of the latch pieces 77, the engaging portions 77*a* also displace inwardly, so that the engagement between the opposing connector 100 and the latch pieces 77 can be released.

Figure 4A:
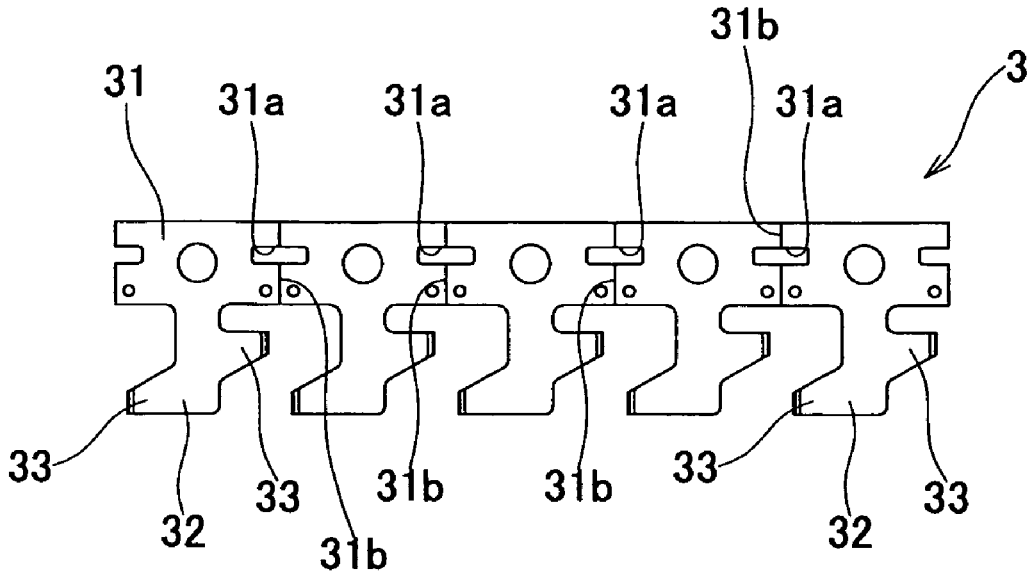
FIG. 4A is a view of the cable retainer of FIG. 2 from above.
Figure 4B:
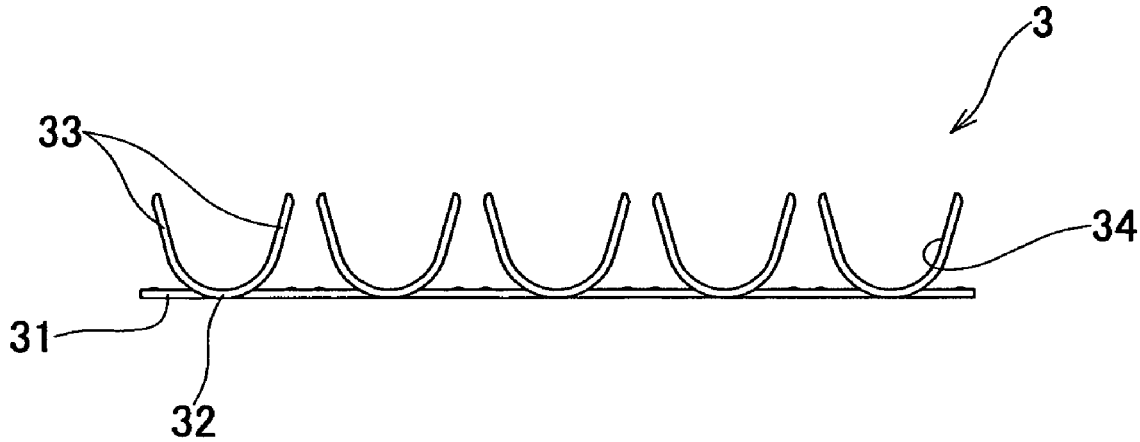
FIG. 4B is a front view of the cable retainer of FIG. 2.

Next, the cable retainer 3 is described in detail with further reference to FIG. 4A and FIG. 4B. FIG. 4A is a view of the cable retainer 3 before retaining the cables 50*a* through 50*e* from above. FIG. 4B is a front view of the cable retainer 3 before retaining the cables 50*a* through 50*e*. As shown in FIG. 2 and FIG. 4, the cable retainer 3 is formed by integral molding of one metal thin plate, and includes a thin plate 31, five main parts 32, and ten caulking portions (projections) 33.

The thin plate 31 is a plate-shaped member extending in one direction. In the thin plate 31, four holes 31*a* that extend along the extending direction of the thin plate 31 and align along the extending direction of the thin plate 31 are formed. When the cable retainer 3 is attached to the housing 4 attached with the lower shell 5*b*, the bent portions 76 penetrate the holes 31*a*. By caulking the bent portions 76 penetrating the holes 31 toward the front end of the connector 1, the bent portions 76 and the cable retainer 3 are engaged with each other and electrically connected to each other. On the thin plate 31, four grooves 31*b* are formed along the width direction of the thin plate 31 at the centers of the holes 31*a*. The thin plate 31 is easily cut along the grooves 31*b*.

The main parts 32 project along the width direction from one end of the width direction of the thin plate 31, and are formed so as to align along the extending direction of the thin plate 31. At the respective main parts 32, caulking portions 33 project from both ends of the width direction so as to cross at right angles and so as not to face each other. As shown in FIG. 4B, one main part 32 and two caulking portions 33 projecting from this main part 32 form a curved portion 34 that is shaped into a semicircle when it is viewed from a position in front of the connector. The two caulking portions 33 can clip the cables 50*a* through 50*d* disposed on the inner surfaces of the curved portions 34 between the caulking portions and the main parts 32 by being plastically deformed by caulking.

Thus, the cable retainer 3 is formed so as to have curved portions 34 corresponding to the number of cables to be retained. Namely, the cable retainer 3 is primarily a long member having a number of curved portions 34, and later, the cable retainer is cut along the grooves 31*b* so as to have curved portions 34 corresponding to the number of cables to be retained. In this embodiment, the cable retainer 3 retains five cables 50*a* through 50*e*, so that the cable retainer is formed so as to have five curved portions 34.

Figure 5:
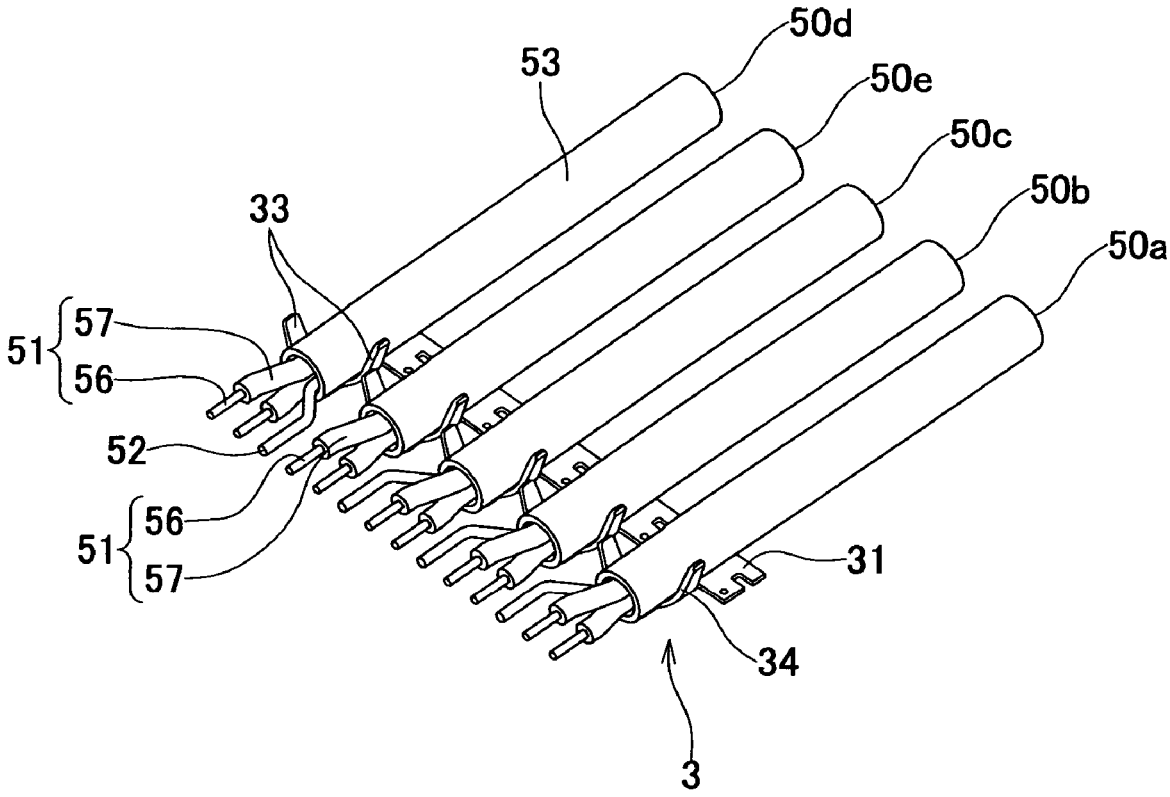
FIG. 5 is a view showing assembling procedures for the connector of FIG. 1.
Figure 6:
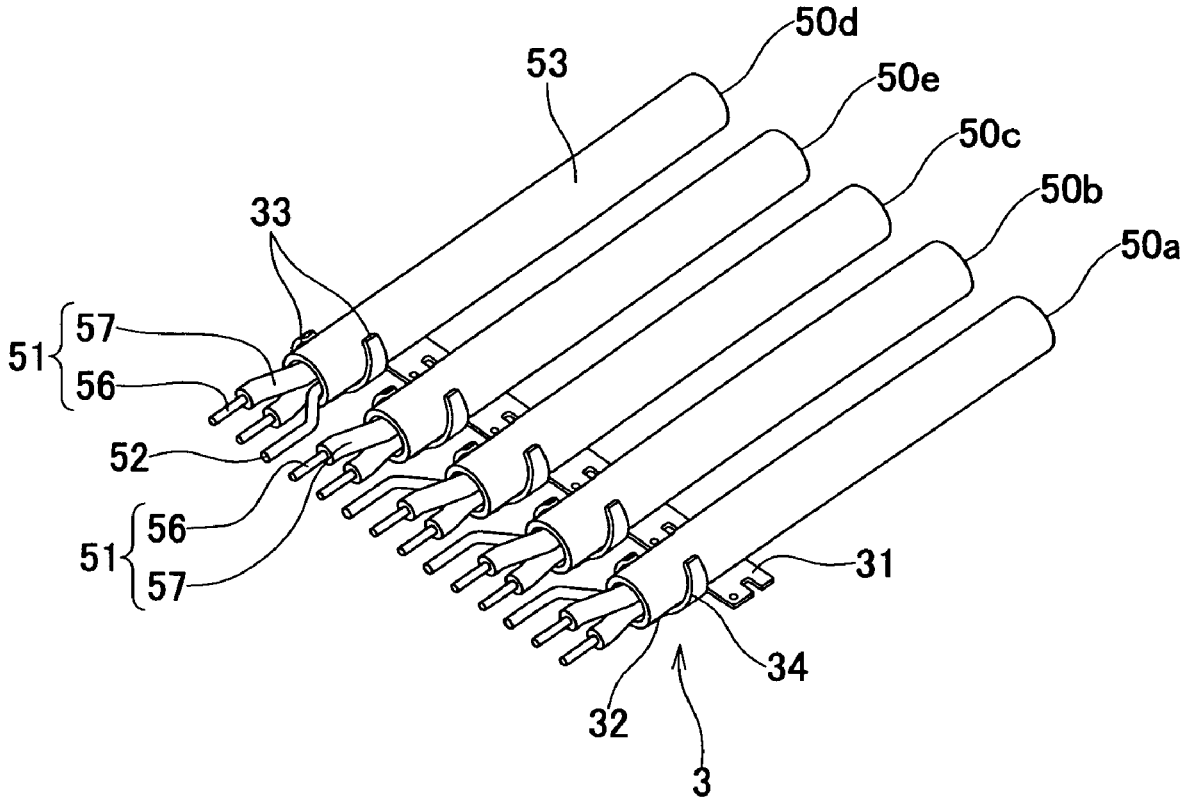
FIG. 6 is a view showing assembling procedures for the connector of FIG. 1.
Figure 7:
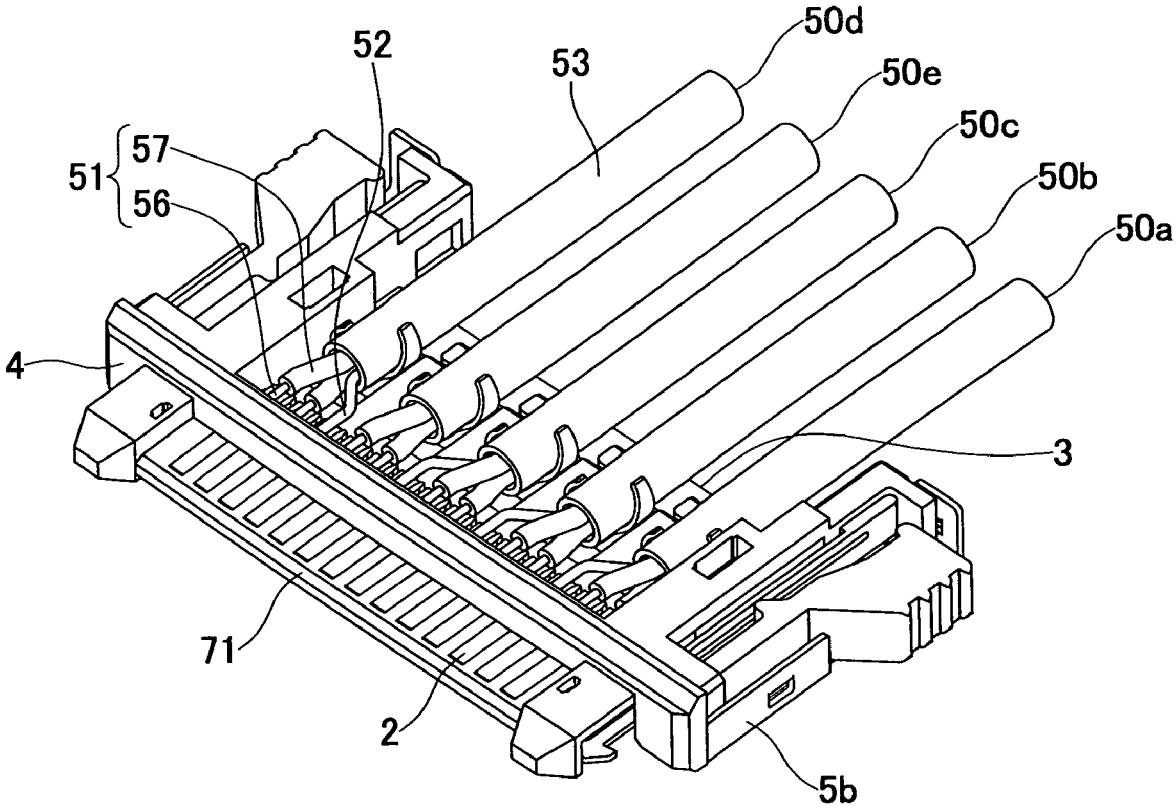
FIG. 7 is a view showing assembling procedures for the connector of FIG. 1.

Next, assembling procedures of the connector 1 are described with reference to FIG. 1 and FIG. 5 through FIG. 7. FIG. 5 through FIG. 7 are views of assembling procedures of the connector 1. As shown in FIG. 5, a cable retainer 3 having five curved portions 34, cables 50*a* through 50*d* including exposed ends of two cores 56 and a groundwire 52, and a cable 50*e* including exposed ends of two cores 56 are prepared, and the jackets 53 of the cables 50*a* through 50*e* are disposed on the inner side surfaces of the curved portions 34 of the cable retainer 3. Thereafter, as shown in FIG. 6, the caulking portions 33 are plastically deformed by caulking so as to clip the cables 50*a* through 50*d* between the same and the main parts 32.

Then, as shown in FIG. 7, the cable retainer 3 that retains the cables 50*a* through 50*d* are disposed in the concave portions 72 and the concave portion 73 of the housing 4 attached with the lower shell 5*b*. At this point, the ends of the bent portions 76 of the lower shell 5*b* penetrate the holes 73*a* formed in the bottoms of the concave portion 73 and project vertically, and the bent portions 76 projecting from the bottoms of the concave portions 73 further penetrate the holes 31*a* of the thin plate 31 of the cable retainer 3. Then, the bent portions 76 penetrating the holes 31*a* are caulked toward the front end of the connector 1, whereby the bent portions 76 and the thin plate 31 are engaged with each other and electrically connected to each other. Namely, the cable retainer 3 and the lower shell 5*b* are electrically connected to each other. Furthermore, the ends of the cores 56 and ground wires 52 exposed from the cables 50*a* through 50*e* are solder-joined to the facing terminals 2.

Last, the lower shell 5*b* is combined with the upper shell 5*a* to form the shell 5 (see FIG. 1). At this point, the upper shell 5*a* and the lower shell 5*b* are electrically connected to each other, and the shell 5 encloses the joined portions between the ends of the cores 56 exposed from the cables 50*a* through 50*e* and the terminals 2.

According to the embodiment described above, since the caulking portions 33 are plastically deformed by caulking, the curved portions 34 can securely retain various types of cables with different diameters.

In addition, in this embodiment, the shell 5 is electrically connected to the cable retainer 3, and the shell 5 encloses the joined portions between the cores 56 of the cables 50*a* through 50*e* and the terminals 2, so that the cores 56 exposed from the cables 50*a* through 50*e* can be efficiently shielded.

Figure 8:
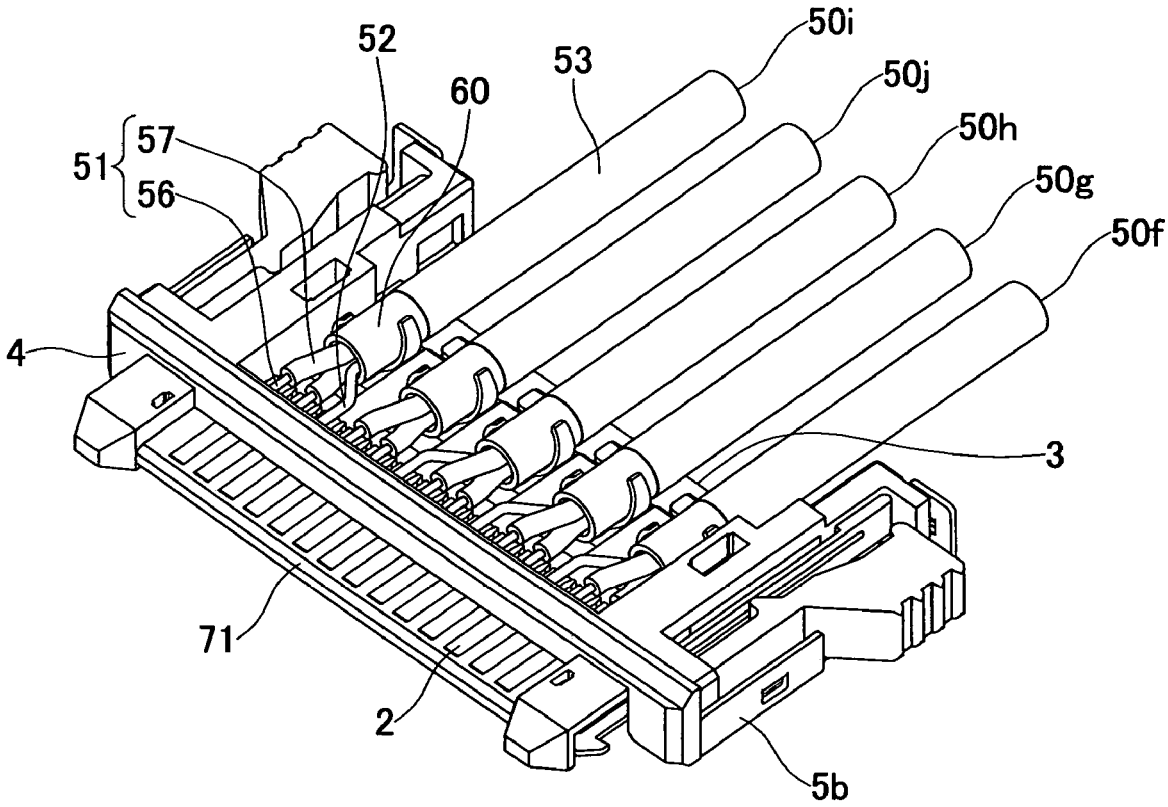
FIG. 8 is a view of another use example in the connector of FIG. 1.

In this embodiment, the cable retainer 3 retains the cables 50*a* through 50*e*, however, the cable types to be retained by the cable retainer 3 are not limited to these. For example, as shown in FIG. 8, it is also possible that the cable retainer retains cables 50*f* through 50*j*. The cables 50*f* through 50*j* include two signal wires 51, a shield material 60 covering the outer circumferences of the two signal wires 51, and a jacket 53 further covering the outer circumference of the shield material 60. The signal wire 51 includes a core 56 and a jacket 57 covering the outer circumference of the core 56. In the cables 50*f* through 50*j* to be connected to the connector 1, the shield materials 60 are exposed from the jackets 53 at the ends of the cables. Then, the ends of the signal wires 51 are exposed from the shield materials 60. At the further ends of the exposed signal wires 51, the ends of the cores 56 are exposed from the jackets 53.

Then, the exposed shield materials 60 of the cables 50*f* through 50*i* are disposed on the inner surfaces of the curved portions 34 of the cable retainer 3, and the caulking portions 33 are plastically deformed by caulking so as to clip the shield materials 60 of the cables 50*f* through 50*i* between the same and the main parts 32. Accordingly, the curved portions 34 and the shield materials 60 are electrically connected to each other, so that the cables 50*f* through 50*i* can be efficiently shielded. Furthermore, the plurality of shield materials 60 can be collectively grounded.

An embodiment of the invention is described above, however, the invention is not limited to the above-described embodiment, and within the scope of the claims for the patent, various design changes are possible. For example, the connector 1 has a conductive shell 5 in the above-described embodiment, however, the invention is not limited to this, and it is also allowed that the shell is not conductive, or no shell is provided.

In addition, in the above-described embodiment, in the cable retainer 3, the caulking portions 33 project so as to cross each other at right angles in the extending direction from both ends of the width direction of the main parts 32 and so as not to face each other, however, the invention is not limited to this construction, and the forms of the caulking portions are arbitrary as long as the curved portions can retain the cables by being plastically deformed by caulking. For example, the caulking portions may project so as to face each other from the main parts, or may project from only one side of the main parts.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A connector, comprising:

a conductive cable retainer that retains a plurality of cables;

a supporter that supports the cable retainer; and a plurality of terminals that are supported by the supporter, wherein the plurality of terminals are joined with cores of the cables retained by the cable retainer, wherein the cable retainer includes:

a thin plate extending in a first direction;

a plurality of main parts that project from the thin plate in a direction substantially perpendicular to the first direction of the thin plate and along the plane of the first direction; and projections that project from the main parts in the first direction, wherein the projections, by being plastically deformed by caulking project substantially perpendicular to the direction of projection of the main parts and the first direction and, clip a plurality of cables disposed on the main parts, wherein the plurality of cables are along a longitudinal direction of the main parts.

2. The connector according to claim 1, wherein the supporter is in contact with the cable retainer and includes a conductive shell that encloses the joints between the cores of the cables and the terminals.

3. The connector according to claim 1, wherein each of the plurality of cables includes the core, an insulator that encloses the core, and a shield material as a mesh-like metal member that encloses the insulator, the projections clip the cables at the shield materials between the projections and the main parts.

4. A cable retainer, comprising:

a conductive thin plate extending in first direction;

a plurality of main parts that project from the thin plate in a direction substantially perpendicular to the first direction of the thin plate and along the plane of the first direction; and projections that project from the main parts in the first direction, wherein the projections, by being plastically deformed by caulking project substantially perpendicular to the direction of projection of the main parts and the first direction and, clip a plurality of cables disposed on the main parts, wherein the plurality of cables are along a longitudinal direction of the main parts.

* * * * *